US008105054B2

(12) United States Patent
Oo et al.

(10) Patent No.: US 8,105,054 B2
(45) Date of Patent: Jan. 31, 2012

(54) OIL RETURN TUBE ALIGNED OVER MOTOR PROTECTOR IN SCROLL COMPRESSOR

(75) Inventors: Chong Yeow Oo, Arkadelphia, AR (US); Zili Sun, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 2012 days.

(21) Appl. No.: 10/927,556

(22) Filed: Aug. 26, 2004

(65) Prior Publication Data

US 2006/0045761 A1 Mar. 2, 2006

(51) Int. Cl.
*F04B 35/04* (2006.01)

(52) U.S. Cl. ..... 417/410.5; 417/372; 417/902

(58) Field of Classification Search ..... 417/410.5
See application file for complete search history.

(56) References Cited

U.S. PATENT DOCUMENTS

| | | | | |
|---|---|---|---|---|
| 6,186,753 | B1 * | 2/2001 | Hugenroth et al. | 418/55.1 |
| 6,386,840 | B1 * | 5/2002 | Williams et al. | 417/371 |
| 6,648,607 | B2 * | 11/2003 | Milliff et al. | 417/228 |
| 2002/0131879 | A1 * | 9/2002 | Fenocchi et al. | 417/410.5 |
| 2003/0002992 | A1 * | 1/2003 | Hugenroth | 417/228 |
| 2004/0170509 | A1 * | 9/2004 | Wehrenberg et al. | 417/371 |

FOREIGN PATENT DOCUMENTS

| | | |
|---|---|---|
| GB | 2 412 945 | 10/2005 |
| JP | 63106393 | 5/1988 |
| JP | 09126177 | 5/1997 |

OTHER PUBLICATIONS

Certified English translation of JP09126177.*
United Kingdom Search Report, Nov. 8, 2005.

* cited by examiner

*Primary Examiner* — Charles Freay
*Assistant Examiner* — Patrick Hamo
(74) *Attorney, Agent, or Firm* — Carlson, Gaskey & Olds

(57) ABSTRACT

A scroll compressor is provided with an oil return tube having an outlet for directing oil toward a motor protector for an electric motor. The oil supply tube is positioned to be at an angle relative to the drive axis of a shaft driven by the electric motor. This ensures that the outlet of the oil supply tube can be properly positioned relative to the electric motor. Under normal conditions, an adequate flow of refrigerant will pull the oil from the oil supply tube and away from the motor protector. However, should there be an inadequate flow of refrigerant within the sealed compressor, the oil will contact the motor protector, which in turn may stop operation of the electric motor.

9 Claims, 4 Drawing Sheets

OIL RETURN TUBE ALIGNED OVER MOTOR PROTECTOR IN SCROLL COMPRESSOR

BACKGROUND OF THE INVENTION

This application relates to a unique location for an oil return tube to ensure that hot oil will be directed onto a motor protector within a sealed compressor, to stop compressor operation during adverse conditions and prevent failure from overheating. Such adverse conditions include, inadequate supply of refrigerant, evaporator or condenser fan failure, etc.

Sealed compressors are utilized to compress a refrigerant in an air conditioning or other environmental conditioning system. As is known, a compressor is sealed, and compresses a refrigerant. The refrigerant is sent to a downstream heat exchanger, and typically a condenser. From the condenser, the refrigerant travels through a main expansion device, and then to an indoor heat exchanger, typically an evaporator. From the evaporator, the refrigerant returns to the compressor.

In the entire refrigerant cycle, there are many reasons why there could be an operating condition that would cause the compressor to overheat and perhaps fail. As one example, the flow of the refrigerant from the indoor heat exchanger, and into the compressor is typically directed over the electric motor for driving the compressor. This refrigerant cools the electric motor, maintaining it at an acceptable temperature. However, and particularly in the case where there is an inadequate supply of refrigerant, the electric motor can become too hot. The same problem could also damage the pump set of the compressor from the heat and effect efficiency. This is undesirable.

Electric motors are typically provided with a motor protector. The motor protector is operable to shut off the motor if there is a spike or other anomaly in the electric power supply. Further, the motor protector is typically provided with some form of temperature sensitive switch that will move to open, and stop operation of the motor should the temperature reach an undesirably high level.

There have been various attempts to address making the temperature sensitive portion of the motor protector more immediately responsive to the actual condition within the compressor. As an example, it might take a relatively long period of time for the inadequate supply of refrigerant in the compressor housing to result in the temperature of the motor protector reaching the high temperature necessary to trip the switch. It would be desirable to reduce the time between the unfavorable condition first occurring, and the stopping of the electric motor operation.

One solution is disclosed in co-pending U.S. patent application Ser. No. 10/235,212, filed on Sep. 5, 2002, entitled "Oil Utilized as Motor Protector Trip for Scroll Compressor," and now U.S. Pat. No. 6,848,889. In this application, oil from a compressor pump unit is directed downwardly, and toward the motor protector. The oil is at an elevated temperature. The flow of refrigerant within the compressor chamber will typically pull the oil away from the motor protector. Thus, as long as there is an adequate supply of refrigerant, the oil will not contact the motor protector. However, if there is a loss of charge, or a low refrigerant flow situation, the oil will not be pulled away from the motor protector. In that instance, the oil will contact the motor protector, which will quickly trip to stop operation of the electric motor.

In the above-referenced co-pending application, it was mentioned that it is the lower mass flow of refrigerant that allows the oil to contact the motor protector. In fact, with further evaluation, it appears possible that it is not the mass flow of refrigerant that will cause the motor protector to be tripped, but rather the elevated temperature of the oil when there is a loss of charge or a low refrigerant flow situation. In either case, the present invention and the above-referenced application both provide a very simple and reliable method of addressing an adverse condition.

While this broad invention is a good solution to the problem, other improvements upon this basic idea can be made.

SUMMARY OF THE INVENTION

In a disclosed embodiment of this invention, the return tube for directing the oil downwardly toward the motor protector is angled relative to an axis parallel to a drive axis of the electric motor. In this manner, the tube can be moved to a location such that it is properly aligned over the motor protector. Structure associated with the tube allows the tube to be mounted at any particular angle, as may be necessary to move the oil to the desired location. In this manner, the entire compressor need not be re-engineered to properly position the tube relative to the motor protector. Rather, existing locations for the oil return tube and the motor protector can be utilized, with only the angle of the tube adjusted to ensure the oil is properly directed.

In another embodiment, the return tube is angled relative to the axis of the electric motor, however it is integrally cast into the crankcase.

These and other features of the present invention can be best understood from the following specification and drawings, the following of which is a brief description.

DETAILED DESCRIPTION OF THE PREFERRED EMBODIMENT

Figure 1:
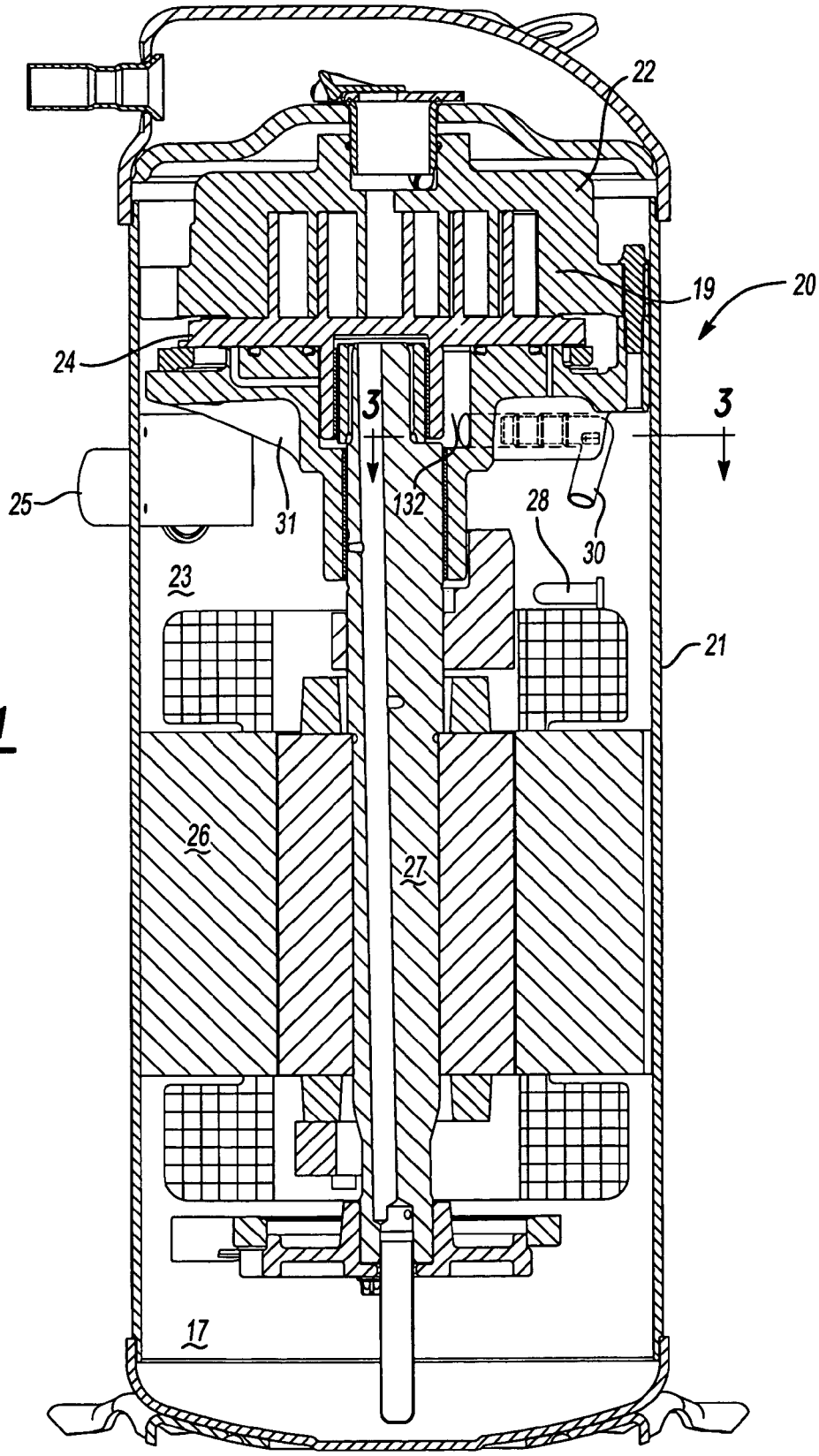
FIG. 1 is a view of a scroll compressor incorporating this invention.

FIG. 1 shows a scroll compressor 20. As shown, a compressor pump set 22 is mounted within a sealed shell 21. A suction chamber 23 receives a suction refrigerant from a tube 25. As can be appreciated, this refrigerant can circulate within the chamber 23, and flows over an electric motor 26. The electric motor 26 drives a shaft 27 that defines an operative axis for the compressor 20, as will be utilized below to explain an important feature of this invention. Compressor pump set 22 includes a non-orbiting scroll 19 and an orbiting scroll 24. As is known, the shaft 27 drives the orbiting scroll 24 to orbit relative to the non-orbiting scroll 19.

An oil chamber 132 receives oil that is passed over the working components of the scroll compressor pump unit 22. This oil will be relatively hot. The oil is returned toward a sump 17 in the bottom of the shell 21 through an oil return tube 30. As explained above, the oil return 30 is positioned such that the oil is directed at a motor protector 28. As is known, the motor protector 28 is operable to stop operation of the electric motor 26 should there be an anomaly in the power supply, or should the temperatures sensed at the motor protector 28 reach an undesirably high level.

Figure 2:
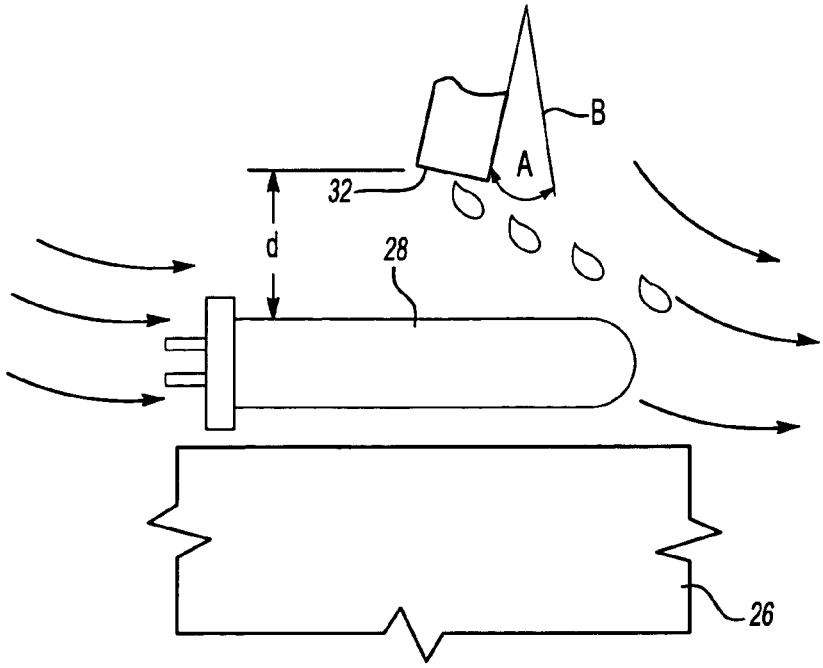
FIG. 2 schematically shows the operation of the oil in the inventive scroll compressor.

As shown in FIG. 2, the inventive oil return 30 has an end 32 that is angled at an angle A relative to an axis B. The axis B is parallel to the rotation axis of the drive shaft 27. By angling the tube 30 at the angle A, the end 32 is positioned, to the left, as shown in FIG. 2, such that it is better positioned relative to the motor protector 28. The angle A combined with the distance d from the end 32 to the motor protector 28 can be selected, as would be appreciated by a worker of ordinary skill in the art, to control when and under which conditions, the motor protector 28 will be caused to trip and stop operation of the motor 26. As shown schematically in FIG. 2, the normal flow of refrigerant will pull the oil droplets from the end 32 such that they do not contact the motor protector 28. However, should there be an operating condition that causes inadequate refrigerant mass flow within the chamber 23, the oil droplets will now not be pulled by the refrigerant, and will contact the motor protector 28. Thus, the arrangement ensures that the operation of the motor protector 28 will be quickly effective to stop operation of the motor 26 if there is an inadequate refrigerant mass flow within the chamber 23.

In the above-referenced co-pending application, it was mentioned that it is the lower mass flow of refrigerant that allows the oil to contact the motor protector. In fact, with further evaluation, it appears possible that it is not the mass flow of refrigerant that will cause the motor protector to be tripped, but rather the elevated temperature of the oil when there is a loss of charge or a low refrigerant flow situation. In either case, the present invention in the above-referenced application both provide a very simple and reliable method of addressing an adverse condition.

Figure 3:
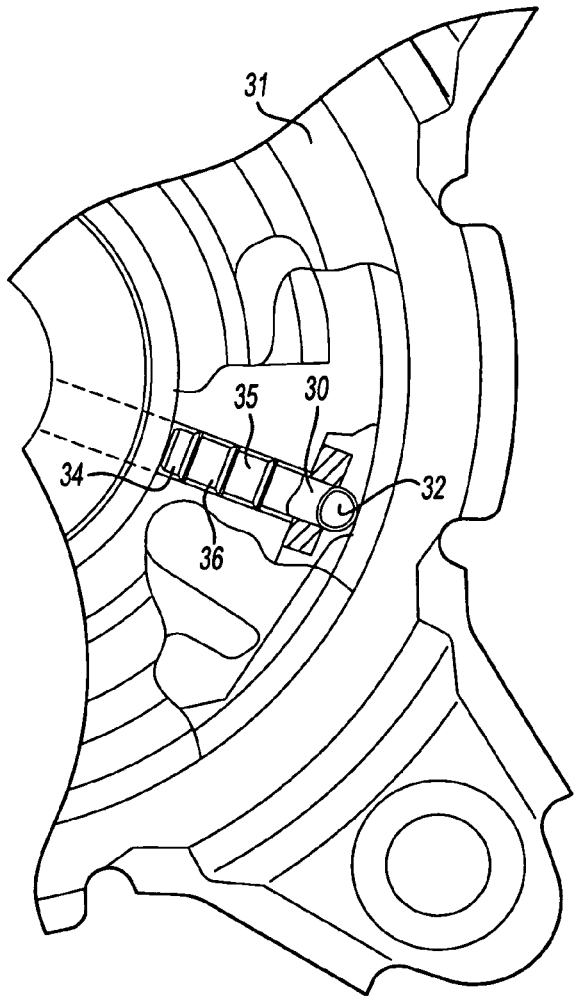
FIG. 3 is a view along line 3-3 as shown in FIG. 1.

FIG. 3 is a cross-sectional view alone line 3-3 as shown in FIG. 1. As shown, a mounting portion 35 of the tube 30 has outwardly extending flanges or barbs 36 that fit within a bore 34 in a crankcase 31. Crankcase 31 supports the orbiting scroll 24, as can be appreciated from FIG. 1, for example.

Figure 4:
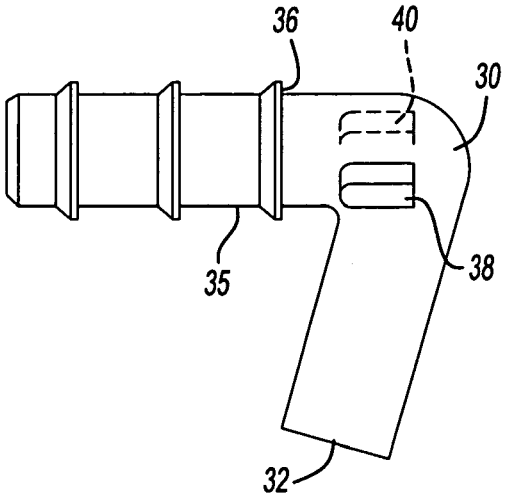
FIG. 4 is a side view of an inventive tube.
Figure 5:
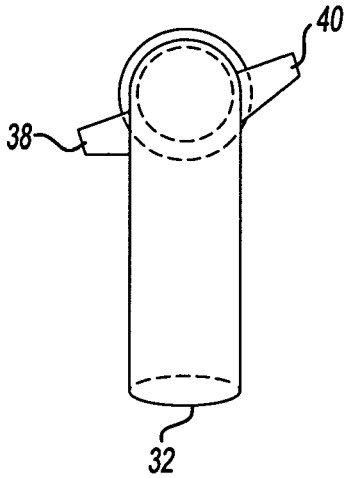
FIG. 5 is a front view of the inventive tube.

FIG. 4 shows a further detail of the tube 30. As shown, the end 32 extends from the mounting portion 35. There are a series of three barbs 36, and mounting wings 38 and 40. As can be appreciated from FIG. 5, the mounting wings 38 and 40 are formed to be at an angle relative to the end 32.

Figure 6:
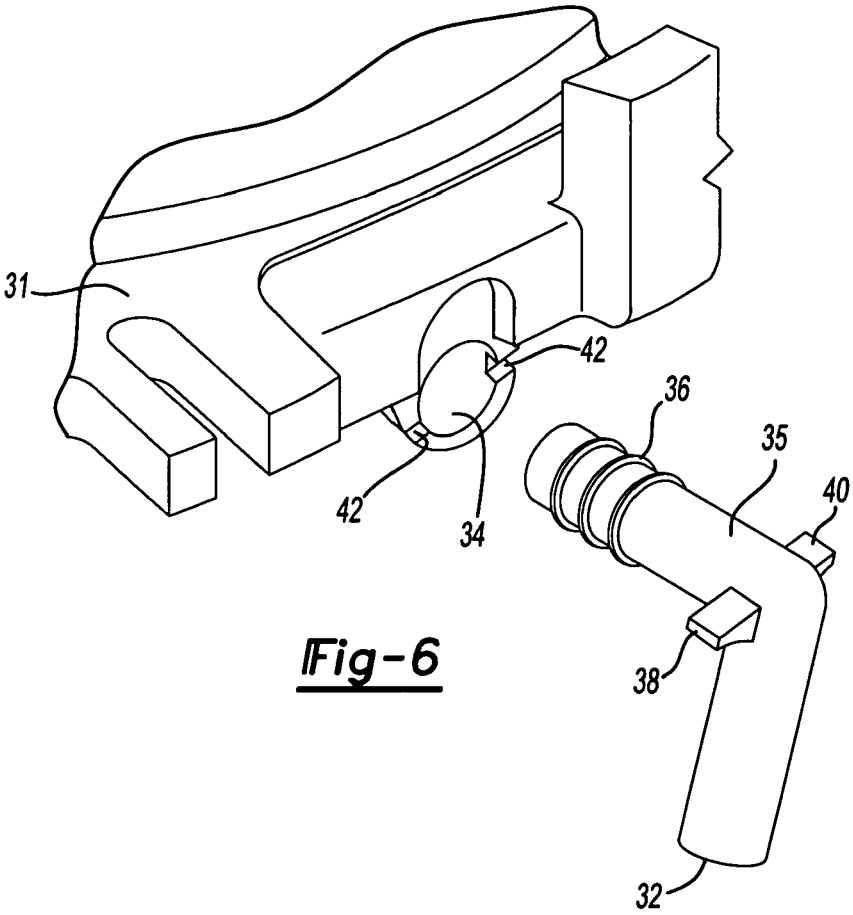
FIG. 6 is an assembly view of a portion of the scroll compressor of FIG. 1.

As can be appreciated from FIG. 6, the crankcase 31 has an opening 34 to receive the mounting portion 35. Further, wing openings 42 receive the wings 38 and 40. By simply tailoring the location of the wings 38 and 40, a scroll designer can properly select the angle A once the wings 38 and 40 are positioned within the openings 42. In this manner, it is relatively easy to achieve a desired angular orientation between the end 32 and the motor protector 28.

Figure 7:
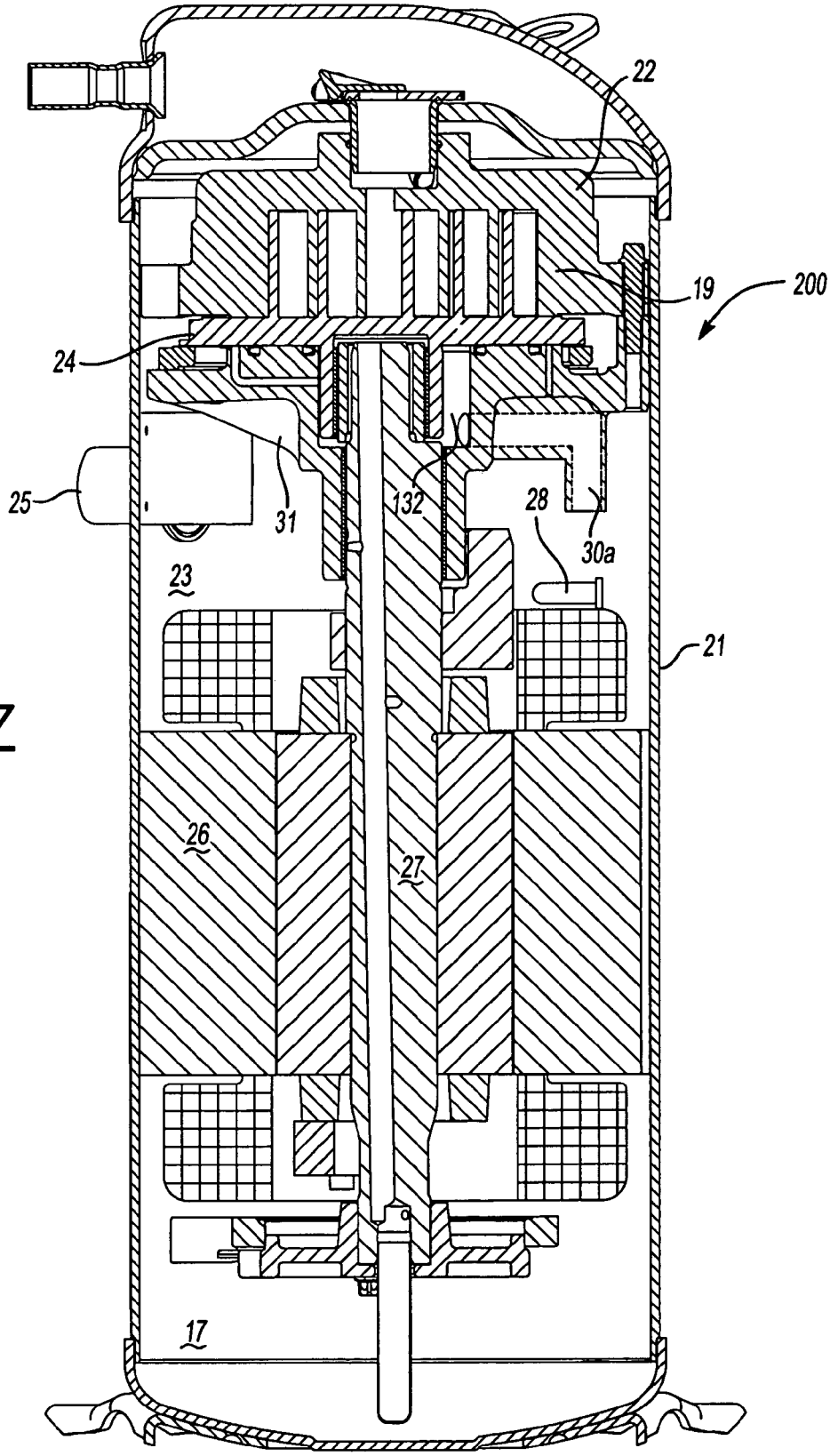
FIG. 7 shows an alternative embodiment.

An alternative embodiment 200 is illustrated in FIG. 7. Alternative embodiment 200 is identical to the earlier embodiment, however, the crankcase 31 is integrally cast with the return tube 30*a* formed into the crankcase 31. Although not clear from FIG. 7, the return tube 30*a* would be at an angle similar to the earlier embodiments. Alternatively, the concept of casting the return tube can also be utilized with a return tube extending directly vertically downwardly towards the motor protector.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

a sealed housing including a suction tube for delivering a suction refrigerant into a suction chamber in said sealed housing;

an electric motor mounted within said suction chamber, said electric motor driving a shaft;

a motor protector mounted adjacent said electric motor, said motor protector being operable to stop operation of said electric motor if said motor protector senses an undesirably high temperature;

a compressor pump unit, said compressor pump unit being provided with a supply of lubricant, said shaft driving said compressor pump unit to compress a refrigerant;

an oil return tube for returning lubricant from said compressor pump unit downwardly into said sealed housing, said oil return tube being positioned such that oil flowing outwardly of said oil return tube will contact said motor protector; and said oil return tube having an outlet at an angle that is non-parallel and non-perpendicular to a drive axis of said shaft, such that oil leaving said outlet of said oil return tube is initially directed in a direction that is non-parallel and non-perpendicular to a drive axis of said shaft.

2. The sealed compressor as recited in claim 1, wherein said compressor pump unit is a scroll compressor pump unit.

3. The sealed compressor as recited in claim 2, wherein said oil return tube is mounted in a crankcase, said crankcase supporting an orbiting scroll of said compressor pump unit.

4. The sealed compressor as recited in claim 1, wherein said oil return tube is mounted at said angle by being received in an opening in a housing, and said oil return tube having a mounting portion mounted within said opening, and said mounting portion having barbs to secure said oil return tube.

5. The sealed compressor as recited in claim 1, wherein said oil return tube is provided with mounting wings extending at an angle relative to said outlet of said oil supply tube, and a housing for mounting said oil supply tube being provided with notches to receive said wings, and the relationship of said wings and said outlet defining said angle of said outlet of said oil supply tube relative to said drive axis of said shaft.

6. The sealed compressor as recited in claim 1, wherein said oil return tube is integrally formed as a part of a crankcase that is a portion of said compressor pump unit.

7. A sealed compressor comprising:

a sealed housing including a suction tube for delivering a suction refrigerant into a suction chamber in said sealed housing;

an electric motor mounted within said suction chamber, said electric motor driving a shaft;

a motor protector mounted adjacent said electric motor, said motor protector being operable to stop operation of said electric motor if said motor protector senses an undesirably high temperature;

a compressor pump unit, said compressor pump unit being provided with a supply of lubricant, said shaft driving said compressor pump unit to compress a refrigerant, said compressor pump unit incorporating a crankcase;

an oil return tube for returning lubricant from said compressor pump unit downwardly into said sealed housing, said oil return tube being positioned such that oil flowing outwardly of said oil return tube will contact said motor protector;

said oil return tube being integrally cast into said crankcase to be positioned to return oil onto said motor protector, at least under some conditions;

said compressor pump unit being a scroll compressor pump unit; and said oil return tube extending at a non-parallel and non-perpendicular angle relative to a drive axis of said electric motor, such that oil leaving said outlet of said oil return tube is initially directed in a direction that is non-parallel and non-perpendicular to a drive axis of said shaft.

8. The scroll compressor as recited in claim 1, wherein said oil return tube is mounted within a crankcase that is part of said compressor pump unit, and one of said oil return tube and said crankcase having at least one positioning wing and the other having at least one notch to receive said positioning wing, with said receipt of said positioning wing in said notch ensuring that said oil return tube be at a desired angle.

9. The scroll compressor as recited in claim 8, wherein said positioning wing is on said oil return tube, and said notch is in said crankcase.

* * * * *